US006866578B2

(12) United States Patent
Orendorff

(10) Patent No.: US 6,866,578 B2
(45) **Date of Patent: *Mar. 15, 2005**

(54) WOODEN VENT COVER

(75) Inventor: Gary R. Orendorff, Beaverton, OR (US)

(73) Assignee: Classic Manufacturing NW LLC, Wilsonville, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/441,996

(22) Filed: May 19, 2003

(65) Prior Publication Data

US 2003/0220069 A1 Nov. 27, 2003

Related U.S. Application Data

(63) Continuation-in-part of application No. 10/383,314, filed on Mar. 7, 2003, now Pat. No. 6,786,817, and a continuation-in-part of application No. 10/154,949, filed on May 23, 2002.

(51) Int. Cl.[7] ..... F24F 13/12

(52) U.S. Cl. ..... 454/290; 137/625.48; 454/324

(58) Field of Search ..... 454/290, 299, 454/324, 274; 137/625.48, 597; 251/326, 328

(56) References Cited

U.S. PATENT DOCUMENTS

| | | | | |
|---|---|---|---|---|
| 1,788,721 A | | 3/1931 | Klomparens | |
| 2,930,309 A | | 3/1960 | Prager | |
| 3,236,171 A | | 2/1966 | Vaskov et al. | |
| 3,509,812 A | | 5/1970 | James | |
| 3,528,359 A | | 9/1970 | Sand | |
| 3,589,265 A | | 6/1971 | Hedrick | |
| 3,938,430 A | | 2/1976 | Koppang | |
| 3,955,483 A | | 5/1976 | Sunter | |
| 3,955,591 A | * | 5/1976 | Baumann | 137/270 |
| 4,319,520 A | | 3/1982 | Lanting et al. | |
| 4,394,958 A | | 7/1983 | Whitney et al. | |
| 4,417,687 A | | 11/1983 | Grant | |
| 4,907,500 A | | 3/1990 | Brown | |
| 5,052,440 A | * | 10/1991 | Frank et al. | 137/625.33 |
| 5,163,871 A | | 11/1992 | Huibregtse et al. | |
| 5,472,380 A | | 12/1995 | Sarazen, Jr. et al. | |
| 6,066,044 A | | 5/2000 | Orendorff | |
| D432,226 S | | 10/2000 | Orendorff | |
| 6,227,962 B1 | | 5/2001 | Orendorff | |
| 6,422,935 B1 | | 7/2002 | Yampolski | |

FOREIGN PATENT DOCUMENTS

| | | |
|---|---|---|
| FR | 730634 | 8/1932 |
| FR | 2 478 252 | 9/1981 |
| GB | 1 349 450 | 4/1974 |
| GB | 1 436 555 | 5/1976 |
| GB | 2 001 413 | 1/1979 |
| IT | 488694 | 12/1953 |

OTHER PUBLICATIONS

Specification sheet entitled "Evaporative Diffusers" by Shoemaker, dated prior to filing of application.

* cited by examiner

*Primary Examiner*—Harold Joyce
(74) *Attorney, Agent, or Firm*—Klarquist Sparkman LLP

(57) ABSTRACT

A wooden vent cover has fixed vanes with major vane surfaces at angles which enhance the throw and spread of air flow through the vent cover. A vent assembly with a wooden vent cover having optimized vane major surface angles including an air flow regulator in combination with the wooden vent cover. The air flow regulator may be a slidable member or other configuration and may be held in place by couplers.

12 Claims, 10 Drawing Sheets

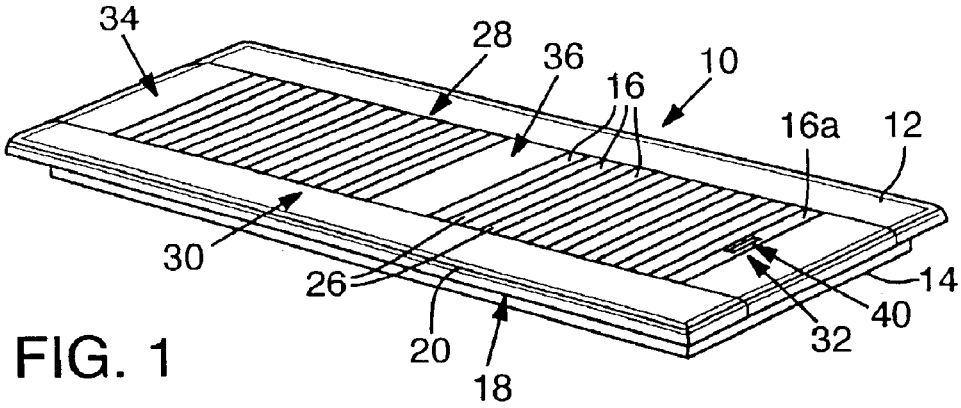
FIG. 1
FIG. 2
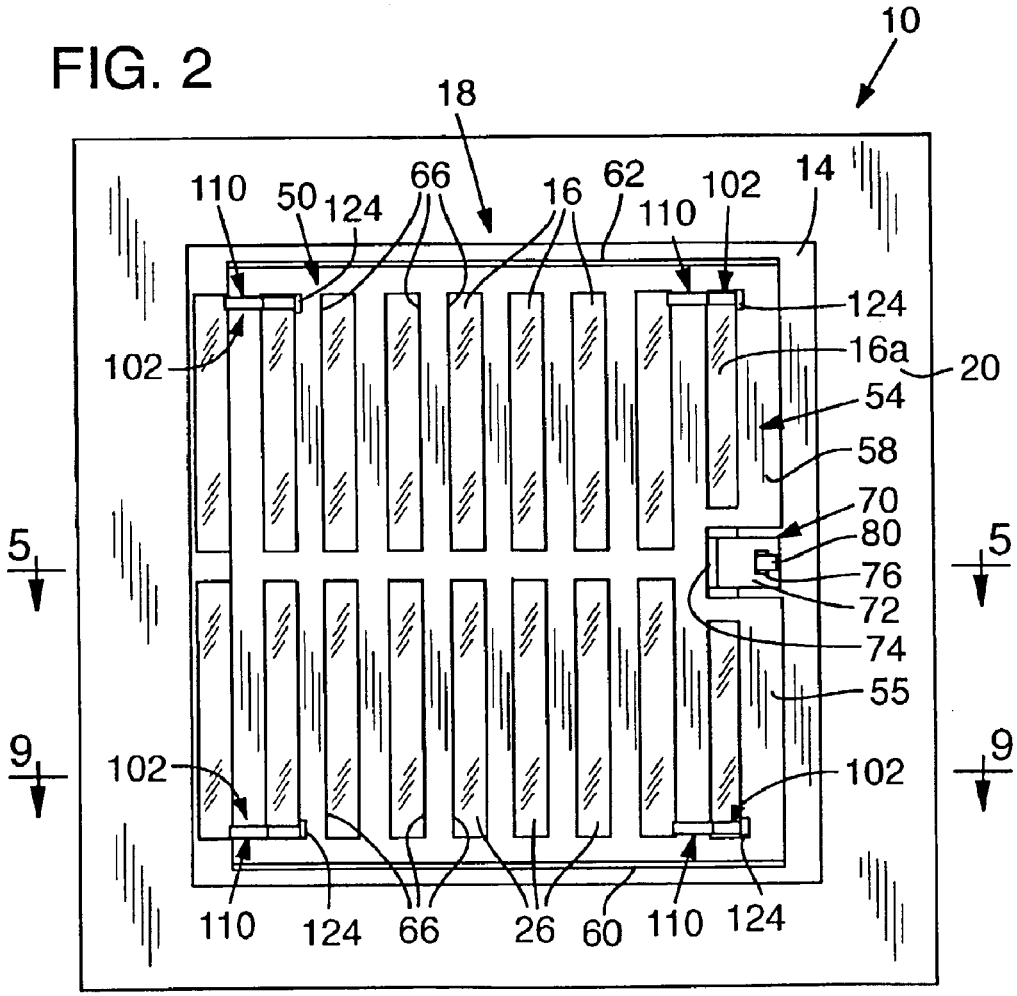

FIG. 5
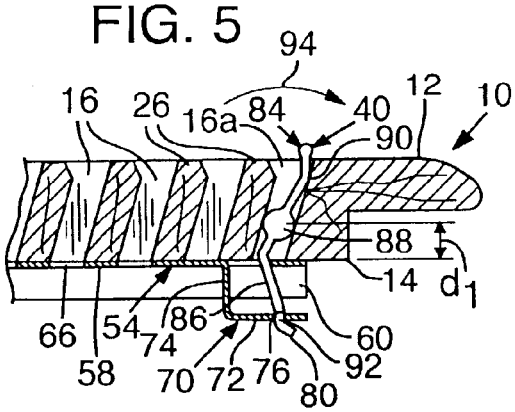
FIG. 6
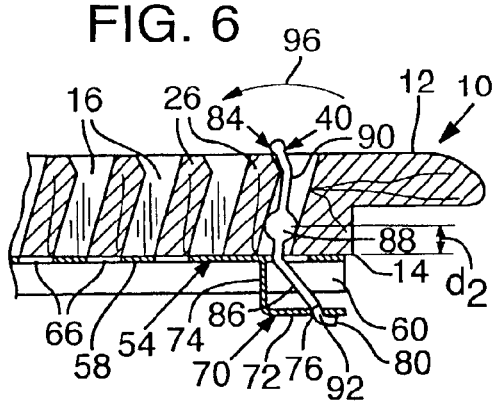
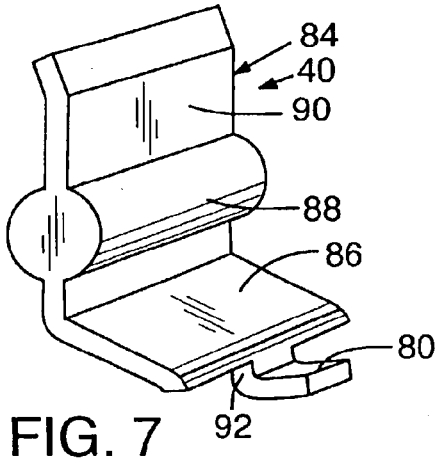
FIG. 7
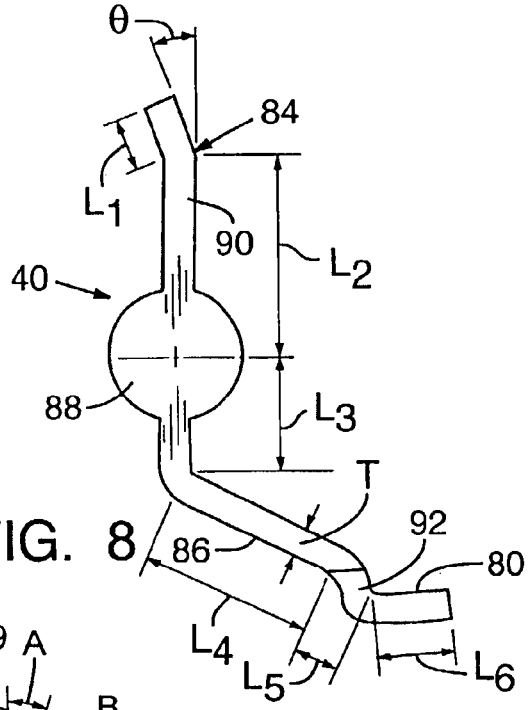
FIG. 8
FIG. 9
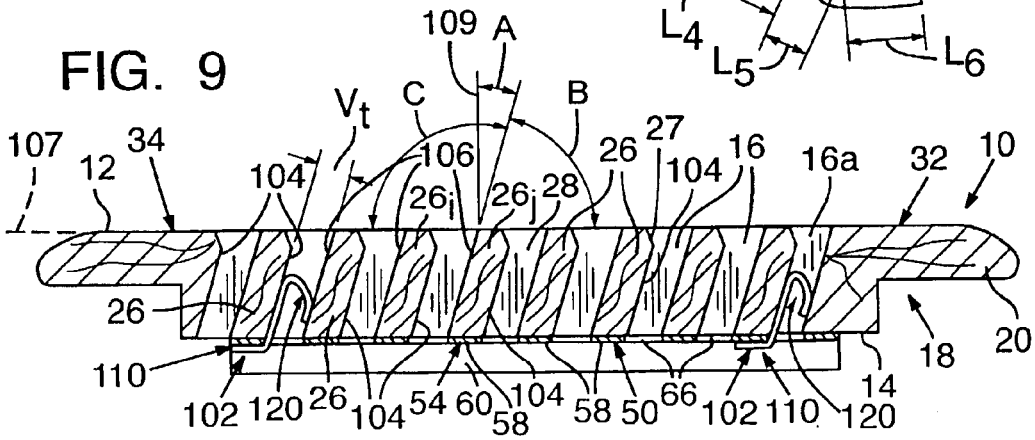

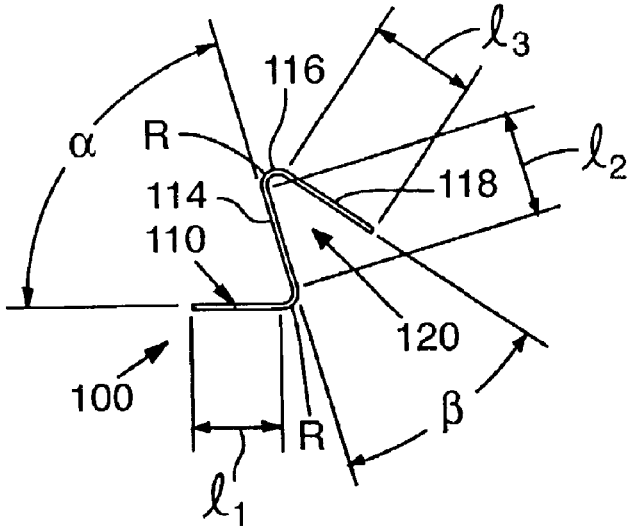
FIG. 10A
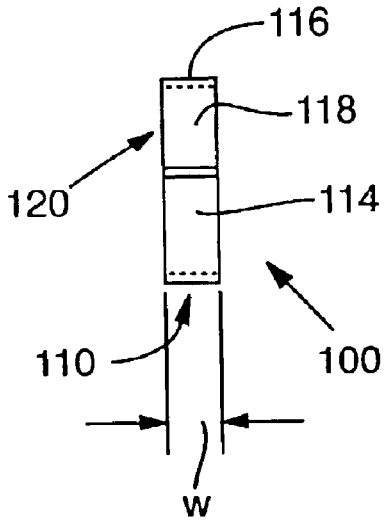
FIG. 11
FIG. 10B $\alpha = 115^{o}$
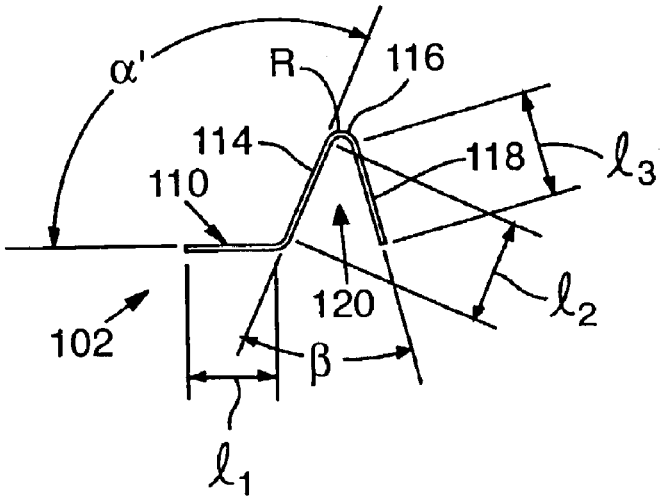

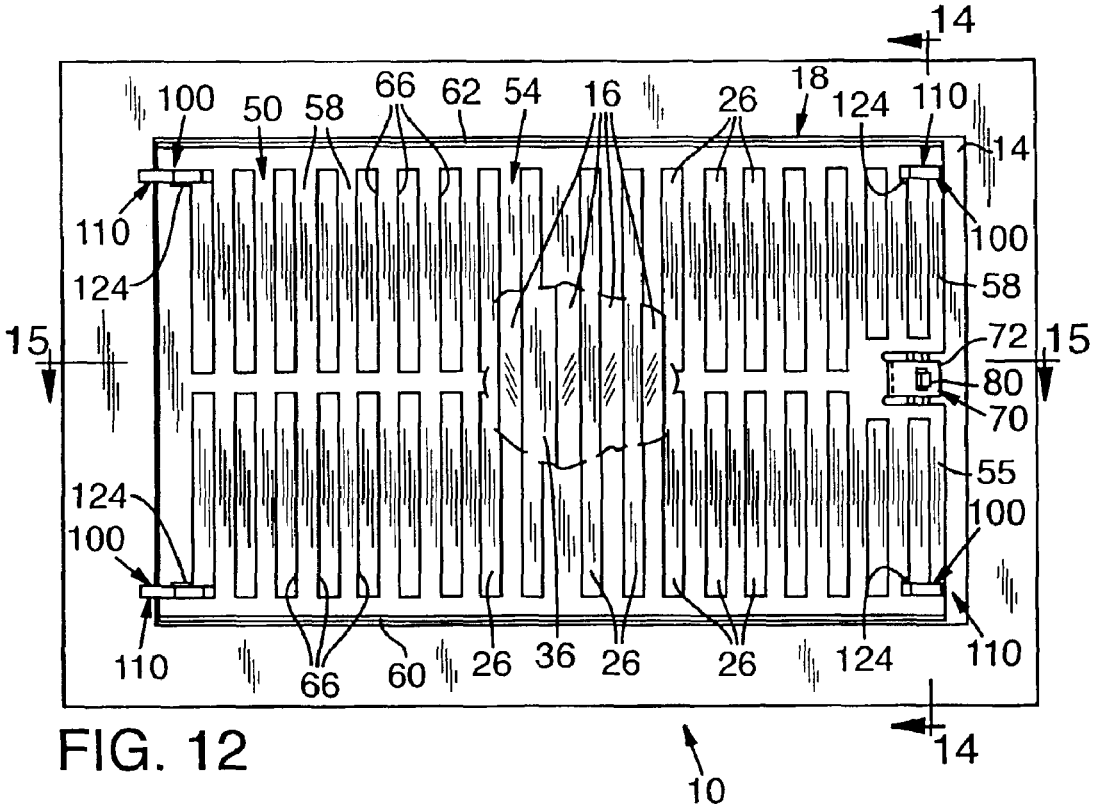
FIG. 12
FIG. 13
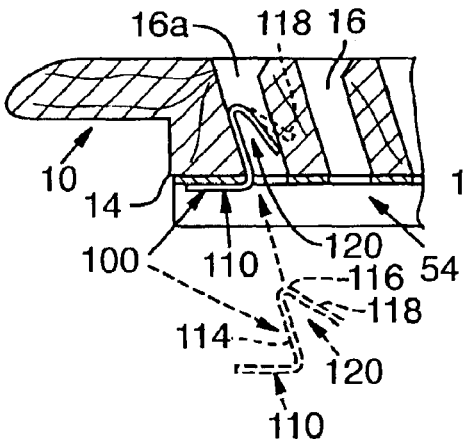
FIG. 14
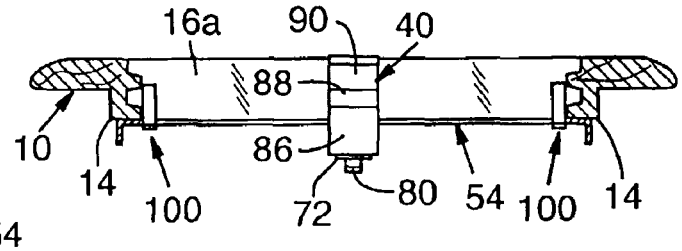

WOODEN VENT COVER

CROSS-REFERENCE TO RELATED APPLICATION

This application is a continuation-in-part of application Ser. No. 10/154,949, filed May 23, 2002, inventor Gary R. Orendorff, and entitled "Vent Assembly and Method", and a continuation-in-part of application Ser. No. 10/383,314, filed Mar. 7, 2003 U.S. Pat. No. 6,786,817, inventor Gary R. Orendorff, and entitled "Vent Assembly", which are each incorporated in their entirety herein by reference.

FIELD

The present invention relates to a wooden vent cover and also to a vent assembly with a wooden vent cover with an air flow regulator slidable relative to the wooden vent cover to control the flow of air through the vent cover.

BACKGROUND

Wooden vent covers with fixed vanes which each have parallel major vane surfaces are known. In one known form of wooden vent cover, major vane surfaces are all oriented at twenty-seven and one-half degree (27½°) in either direction from vertical when the vent cover is positioned in a horizontal orientation. Thus, these vane surfaces are either at sixty-two and one-half degrees (62½°) or one hundred and seventeen and one-half degrees (117½°) from horizontal. Rectangular vent covers of this construction are known with all of the vanes positioned at the same angle. In another known form, the vent cover defines side-by-side rectangular openings at either side of a central divider. A first set of vanes which have major surfaces at twenty-seven and one-half degrees (27½°) in a first direction from vertical are supported in one of the side-by-side openings. In addition, a second set of vanes are supported in the other of the side-by-side openings with their major vane surfaces oriented at twenty-seven and one-half (27-½°) degrees in the opposite direction from vertical.

Stamped metal vent covers are also known which have vanes with major surfaces at an angle which varies moving from the center of the vent cover to the ends of the vent cover. For example, with the vent cover in a horizontal orientation, these vanes may have major vane surfaces which are vertical (0 degrees) at the center of the vent cover with an increasing angle from vertical moving toward the outer ends of the vent cover, such as thirty degrees (30°) or more from vertical for the vanes which are furthest from the center. Vent covers of plastic with these variable angled vanes are also known.

It is also known to use an air flow regulator in combination with a vent cover to control the flow of air from a vent and through the regulator and vent cover. U.S. Pat. No. 6,227,962 to Orendorff, which is incorporated by reference herein in its entirety, discloses an air flow regulator of the type which has louvers which pivot between closed and various open positions and which is supported beneath the vent cover.

Other vent assemblies with vent covers and air flow regulators are designed to have a sliding air flow regulator which is supported to slide relative to the vent cover. For example, U.S. Pat. No. 5,472,380 to Sarazen, Jr. et al. is understood to illustrate a construction in which a register or vent cover slidably receives a slide grill. The register defines a groove between the underside of vanes of the register and the upper surface of ridges formed in opposed sidewalls of the register. A handle, or tab, which can be integrally formed as part of the slide grill, extends upwardly in the space between two vanes of the cover so that it can be used to slide the grill.

U.S. Pat. No. 2,930,309 to Prager is understood to disclose an adjustable ventilator which has a vaned louver plate on one surface of a wall. A slidable plate assembly is located at the opposite side of the wall. The slidable plate assembly includes a cover having a plurality of openings which overlie a slide plate. Handles extend through slots in the cover and are used to slide the slide plate to selectively block or open the openings through the cover.

Although constructions of this type are known, a need exists for an improved vent cover and vent assembly.

SUMMARY

The present invention is directed toward new and unobvious aspects of a wooden vent cover and also to aspects of vent assemblies comprising an improved wooden vent cover in combination with an air flow regulator, alone and in various combinations and subcombinations with one another. The invention is not limited to a wooden vent cover, or to a wooden vent cover in combination with an air flow regulator, which includes all of the various components described below in connection with illustrated embodiments.

In this disclosure, the term "wooden vent cover" means a vent cover which is formed of wood components, but also includes vent covers of wood components with fasteners (e.g., brads) or inserts of other materials, and/or vent covers of wood components which are secured together by adhesive with or without other fasteners or inserts components. Desirably, there are no such inserts or fasteners and the wood components are secured together solely by adhesive.

In accordance with one embodiment, a wooden vent cover has a plurality of air flow openings at least some of which are defined between fixed wooden vanes. Desirably, these vanes each have opposed major first and second surfaces which are parallel to one another. By major surface, it is meant a surface which extends at least along one-half of the vane and more desirably substantially along the entire surface at one side of the vane. This does not preclude, for example, the inclusion of a bevel or inclined surface at one or both sides of a vane which intersects a major surface of the vane. Such a beveled surface, for example, may be positioned along the upper edge of the vane near the front surface of the vent cover. The front surface refers to the surface of the vent cover which is exposed when the vent cover is positioned to overlay a vent opening. The front surface of the vent cover may define a plane which is generally horizontal when the vent cover is oriented in a horizontal orientation. The major vane surfaces are most desirably at an angle varying from about twelve degrees (12°) to about seventeen degrees (17°) from either side of vertical (73° to 78° or about 102° to 107° from horizontal) when the vent cover is in a horizontal orientation. A particularly desirable vane angle is sixteen degrees (16°) either side of vertical (74° or 106° from horizontal) when the vent cover is in a horizontal orientation. This angle may also be referenced from a plane which is perpendicular to a plane defined by the front surface.

In accordance with one aspect of an embodiment, all of the major vane surfaces of a vent cover are fixed at the same angle. The vent cover may comprise a wooden vent body which defines a central opening with the vanes being wooden and positioned within the vent opening and with the major vane surfaces at the desired angle.

In another form, the major vane surfaces at one side of a central vent cover location are angled in one direction from vertical, when the vent cover is in a horizontal orientation, and the vane surfaces at the opposite side of the central portion are angled at the opposite angle from vertical. Desirably, all of the major vane surface angles at a first or one side of the central portion of the vent cover are at the same first angle and all of the major vane surfaces at the second or opposite side of the central portion are at the same second angle. The first and second angles can also desirably be of the same magnitude from vertical, or from a plane perpendicular to a plane defined by the front surface, but in opposite directions from vertical. A particularly desirable angle is sixteen degrees (16°) from vertical.

A vent assembly may comprise a wooden vent cover of such construction in combination with an air flow regulator. Although the air flow regulator may be of any suitable form and may be permanently or detachably mounted to the vent cover, in one specific embodiment, the air flow regulator is slidable relative to the wooden vent cover from a first closed position in which the air flow regulator substantially blocks the flow of air through the air flow openings to second open positions in which air flow paths are provided through the air flow regulator and air flow openings. By substantially blocking the flow of air, it is meant that the air flow is severely restricted as some air flow leakage or minimal air flow may still take place even though the air flow regulator is in the closed position. One or more open positions may be provided with the air flow being less restricted by the air flow regulator as the air flow regulator is moved toward its most open position.

In one specific embodiment, one or more couplers, which may be detachable, interconnect the air flow regulator and the vent cover at a first end portion of the vent assembly. In addition, one or more such couplers interconnect the air flow regulator and the vent cover at a second end portion of the vent assembly. These exemplary couplers permit sliding of the air flow regulator relative to the vent cover. These couplers may be detachable without the use of tools. As a specific example, these couplers may each comprise at least one first coupler portion coupled to the air flow regulator and at least one second coupler portion frictionally coupled to the wooden vent cover. The first coupler portion of each coupler may support the air flow regulator. The at least one second coupler portion may be inserted into a coupler receiving opening in the wooden vent cover, such as into an air flow slot between wooden vanes of a wooden vent cover. The second coupler portion may frictionally engage the boundaries defining the coupler receiving opening, such as the major surfaces of the walls of the air flow directing wooden vanes, to retain the air flow regulator in a coupled relationship to the wooden vent cover.

BRIEF DESCRIPTION OF THE DRAWINGS

FIG. 1 is a perspective view of one form of a wooden vent cover assembly in accordance with an embodiment of the present invention.

FIG. 2 is a bottom view of a vent assembly with a wooden vent cover in accordance with a second embodiment.

FIG. 5 illustrates one form of actuator for shifting the air flow regulator between open and closed positions with the actuator shown in an air flow regulator open position in FIG. 5.

FIG. 6 is similar to FIG. 5 with the actuator shown in an air flow regulator closed position in FIG. 6.

FIG. 7 is a perspective view of the actuator embodiment shown in FIGS. 5 and 6.

FIG. 8 is a side elevational view of the actuator of FIG. 7.

FIG. 9 illustrates a vent assembly with one form of couplers for coupling an air flow regulator or slide member to a vent cover.

FIG. 10A is a side elevation view of one of the couplers of FIG. 9.

FIG. 10B is a side elevation view of another of the couplers of FIG. 9.

FIG. 11 is a front view of one of the couplers of FIG. 9.

FIG. 12 is a bottom plan view of the vent cover and air flow regulator assembly of FIG. 1.

FIG. 13 is a schematic sectional view illustrating the installation of a coupler.

FIG. 14 is a transverse sectional view, taken along line 14—14 of FIG. 12.

DESCRIPTION OF ILLUSTRATED EMBODIMENTS

Figure 4A:
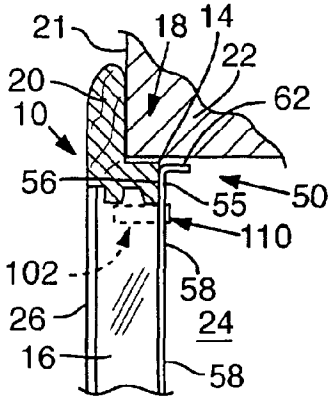
FIG. 4A is a transverse sectional view of a portion of the vent assembly of FIG. 3 taken along line 4A—4A of FIG. 3.

FIG. 1 illustrates one form of vent assembly comprising a wooden vent cover 10. The illustrated wooden vent cover has first and second major opposed surfaces 12,14 with a plurality of vent openings, some being indicated at 16, which extend between surfaces 12,14 and through which air may flow. The illustrated wooden vent cover 10 has an inward step around its perimeter, as indicated at 18, with an overhanging projecting rim portion 20 about the perimeter of the wooden vent cover. As can be seen in FIG. 4A, the undersurface of rim 20 may engage the upper surface 21 of a portion of a floor 22 or other support through which a duct opening 24 extends. The step 18 allows the wooden vent cover to be inserted downwardly into the duct opening.

The air flow openings 16 in the illustrated wooden vent cover may be of any configuration and desirably comprise elongated slots which are spaced apart from one another by respective wooden vanes. Two of these vanes are indicated at 26 in FIG. 1. These vanes have wall surfaces which bound and define the respective sides of the air flow slots 16 and are typically angled to assist in directing air as it flows outwardly from the vent assembly. The vanes 26 extend between respective wooden side members or portions 28,30 of the illustrated vent assembly. Side members 28,30, in this example, bound and define the respective ends of the air flow slots 16. First and second wooden end members or portions 32,34 extend between the respective side members 28,30 at the respective ends of the wooden vent cover and complete a wooden frame or body around the perimeter of the wooden vent cover. A central wooden crosspiece or divider 36 is also provided approximately midway between the respective ends of the wooden vent cover 10. The crosspiece 36 also passes between side members 28,30. The air flow slots 16 toward the right side of crosspiece 36 in FIG. 1 may be angled to direct air away from the crosspiece. The slots at the opposite side of the crosspiece are typically angled in the opposite direction. One of these air flow slots, in FIG. 1 the endmost air flow slot indicated at 16*a* to distinguish it from the other slots 16, has a vent assembly actuator indicated generally at 40 positioned, in this example, at least partially therein. Actuator 40 is used to shift the position of an illustrated form of air flow regulator such as a slide member. The air flow regulator is slidably coupled to the wooden vent cover 10 so as to be slid to various positions to control the flow of air from the duct and through the air flow slots 16. Alternatively, although less desirable, other forms of air flow regulators may be used, such as disclosed in U.S. Pat. No. 6,227,962.

In the embodiment of FIG. 1, the vent cover frame is comprised of side pieces 28,30 and end pieces 32,34, together with a divider 36. The frame and divider define two side-by-side openings which, in the illustrated embodiment, are rectangular in configuration. A first set of vanes 26 are supported by respective side pieces 28,30 at a fixed location and extend within the opening at one side of the divider 36, for example, at the left side of the divider shown in FIG. 1. A second set of vanes 26 are supported by the side pieces 28,30 and extend within the opening at the opposite side of the divider 36 from the first set of vanes, for example at the right side of the divider 36 shown in FIG. 1. In the embodiment of FIG. 9, no central divider is provided.

Figure 16:
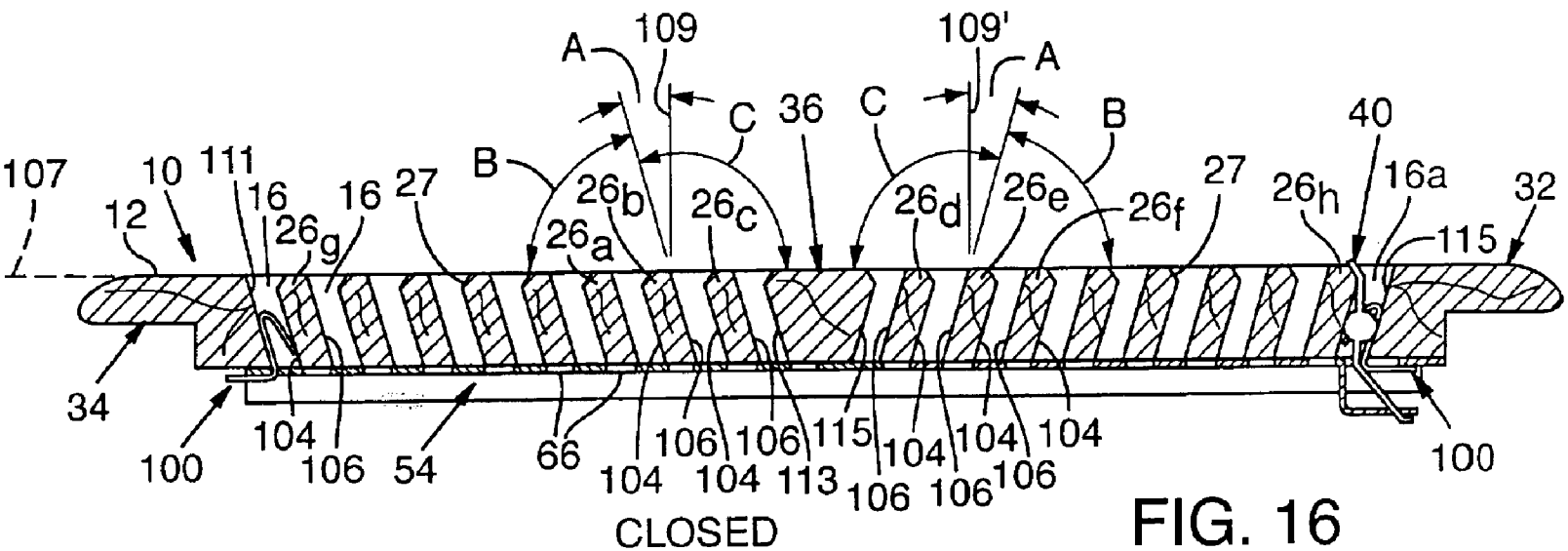
FIG. 16 is like FIG. 15 except with the vent assembly closed.

With reference to FIG. 16, a plurality of the slots 16 are defined between respective adjacent wall surfaces of adjacent vanes. Consider for example the vanes labeled 26*a*, 26*b* and 26*c* in FIG. 16. In the example under discussion, these latter three vanes are part of the first set of vanes. Each of these vanes 26*a*, 26*b* and 26*c* have major opposed vane surfaces 104,106 which are desirably planar and which are most desirably parallel to one another. By major vane surface, it is meant that a majority and most desirably substantially all of the respective side surface of the vane. It should be noted that for ornamentation reasons (to make the vane appear thinner when looking down from above), a bevel or chamfer is provided at the upper end of the wall surface 104. Although not required, this beveled surface may be at an angle of, for example, 53 degrees from a plane which contains wall surface 104. One of these beveled surfaces is indicated at 27 for vane 26*a* in FIG. 16.

The top or front surface 12 of the vent cover in FIG. 16, although not necessarily planar, can be used as a reference surface for a plane 107 which can be defined by surface 12. For example, plane 107 may be tangent with the majority of surface 12 if surface 12 is primarily planar. Alternatively, for example, an average or other approximation of points on surface 12 may be used to define a reference plane. In addition, in FIG. 16 a reference plane 109 is shown perpendicular to the plane 107. In the embodiment shown, plane 109 is perpendicular to a planar portion of front surface 12 and extends vertically when the vent cover is oriented in a horizontal orientation as shown in FIG. 16. A similar plane 109' is shown to the right side of center piece 36 in FIG. 16.

Desirably, major surface 106 is at an angle varying from about twelve degrees (12°) to about seventeen degrees (17°) from plane 109. The term "about" is intended to encompass less than a one degree variation, such that a range of from about twelve degrees (12°) to about seventeen degrees (17°) is from greater than eleven degrees (11°) to less than eighteen degrees (18°). In FIG. 16, for vanes 26*a*, 26*b* and 26*c*, the angle A thus is desirably in this range and more desirably is from twelve degrees (12°) to seventeen degrees (17°) counterclockwise from plane 109. In addition, major surfaces 106 for vanes 26*d*, 26*e* and 26*f* (exemplary vanes at the right side of divider 36 in FIG. 16) are also desirably within this about twelve degrees (12°) to about seventeen degrees (17°) range and are more desirably from twelve degrees (12°) to seventeen degrees (17°) from plane 109', but in this case in a clockwise direction from plane 109'. As an alternative way of describing the angle of major surfaces 106, angle B between plane 107 and a plane defined by major surface 106 is from about seventy-three degrees (73°) to about seventy-eight degrees (78°) or angle C from plane 107 to the plane defined by major surface 106 is from about one hundred and two degrees (102°) to about one hundred and eight degrees (108°), (these latter angles B and C being from horizontal in FIG. 16). Angles C and B, for vanes 26*d*, 26*e* and 26*f* are in the same range. A particularly desirable vane angle A is sixteen degrees (16°) either side of vertical (seventy-four degrees (74°) or one hundred and six degrees (106°) from horizontal). Desirably, the major surfaces 104 of the vanes are at an angle which is selected to also be in the range of from about twelve degrees (12°) to about seventeen degrees (17°) either side of vertical, more desirably twelve degrees (12°) to seventeen degrees (17°) and with sixteen degrees (16°) either side of vertical being a particularly desirable angle. In addition, most desirably, surfaces 104 and 106 are parallel to one another and thus these two major surfaces of the same vane have the same angle. In addition, in the particularly desirable embodiment of FIG. 16, all of the major surfaces of the vanes at one side of the divider, e.g., the first set of vanes, are at a first angle and all of the major surfaces of the vanes at the opposite side of the divider are at the same angle but in the opposite direction from vertical.

In addition, the surface 111 adjacent to surface 104 of the left-most vane 26*g* in FIG. 16, is desirably at the same angle as the surfaces 106 of the set of vanes at the left side of the divider in this figure. Also, the surface 115 at end piece 32 adjacent to the right-most vane 26*h* in FIG. 16, is desirably at the same angle as the angle of the surfaces 106 of the set of vanes at the right side of the divider 36 in FIG. 16. In addition, the surface 113 at divider 36, adjacent to vane 26*c*, desirably has the same angle as the surface 104 for the vane 26*c*. In addition, the surface 115 of divider 36, at the right hand side of the divider in FIG. 16, desirably has the same angle as the surface 106 of the vane 26*d* adjacent to the divider 36.

In the FIG. 9 embodiment, which lacks a center divider, the respective frame components of the vent cover define a single central opening, which may be rectangular. The vanes 26 extend within this single opening and are positioned at a fixed location. Vanes 26*i* and 26*j* are specifically identified in this figure and have respective major wall surfaces 104 and 106. These major vane surfaces 104,106 may have the same configuration and are desirably at the same angle as the corresponding vane surfaces for the vanes described above in connection with FIG. 16. For example, the major surfaces 104 and 106 of vanes 26*i* and 26*j* desirably are in the same range as the major vane surfaces of the vanes 26*d* and 26*e* in FIG. 16. Thus, angles A, B and C in FIG. 9 are desirably identical to the described angles and ranges set forth above in connection with the description of FIG. 16.

Figure 3:
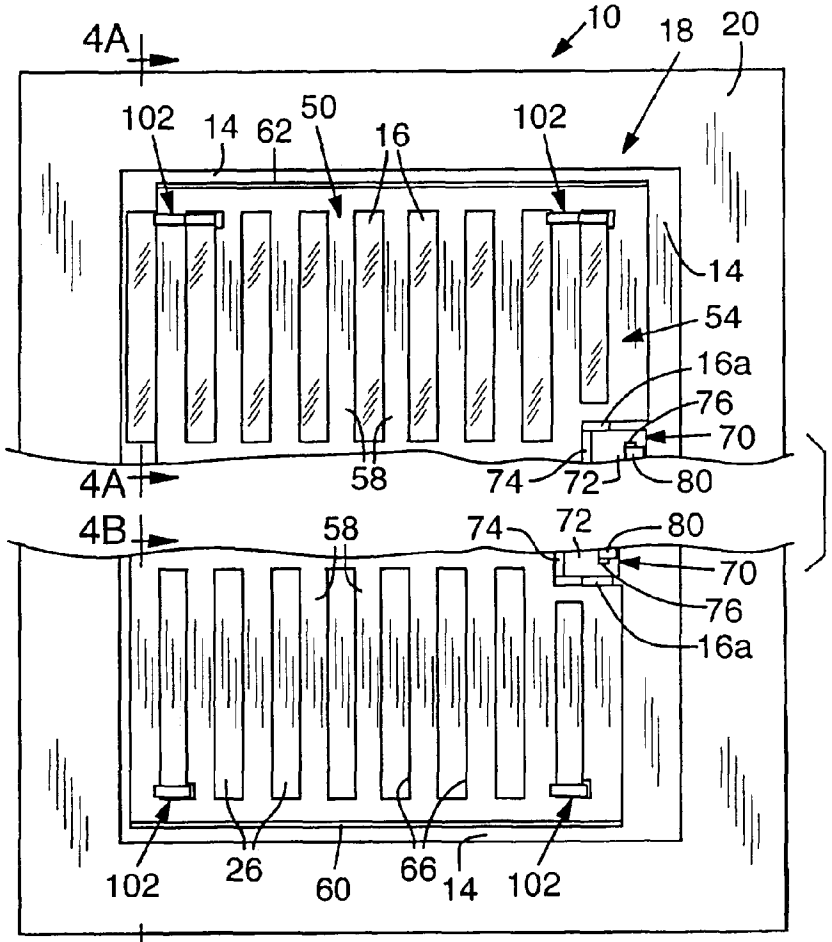
FIG. 3 is a view similar to FIG. 2 with a slide member or air flow regulator shown in a fully opened position in the upper portion of FIG. 3 and in a closed position in the lower portion of FIG. 3.
Figure 4B:
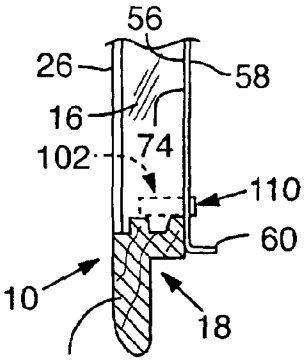
FIG. 4B is a transverse sectional view of a portion of the vent assembly of FIG. 3 taken along line 4B—4B of FIG. 3.

FIG. 2 illustrates the underside of a form of vent assembly having a wooden vent cover 10 like that shown in FIG. 1 except that the wooden vent cover is of a shorter length than that shown in FIG. 1 and lacks the central crosspiece 36. FIG. 2 illustrates one form of an air flow regulator 50 which is slidably coupled to the wooden vent cover 10. In the form shown, the air flow regulator comprises a slide member 54 which may comprise a generally planar plate 55 having opposed first and second major surfaces 56,58 (see FIG. 4A). In the illustrated form in FIG. 2, air flow regulator 50 is rectangular and has four corners. In the embodiment shown, the surface 56 is an upper surface of plate 54 and is positioned adjacent to the surface 14 of the wooden vent cover 10. In addition, the surface 58 is spaced away from the surface 14 and is exposed to view in the embodiment of FIG. 2 when looking at the rear or underside of the vent assembly. The plate 55 has first and second reinforcing side flanges 60,62. The respective flanges 60,62 project outwardly away from the surface 58 and away from the wooden vent cover surface 14. The illustrated slide member 54 has a plurality of spaced apart air flow openings extending between the surfaces 56,58 with some of these openings being indicated at 66 in FIG. 2. Openings 66 may take any convenient configuration. In the illustrated form, these openings comprise elongated rectangular slots extending transversely relative to the longitudinal axis of the plate 55. In FIG. 2, the slide member 54 is shown positioned in a fully open position. In this position, the slots 66 are aligned with corresponding air flow openings 16 of the wooden vent cover. Consequently, minimal resistance is provided to the flow of air upwardly through the slide member and wooden vent cover. In contrast, when slide member is shifted to a fully closed position, the portions of the slide member between the openings 66 are aligned with the air flow openings 16 through the wooden vent cover. This substantially blocks the flow of air through the wooden vent cover. Intermediate open positions are also possible depending upon the extent of the alignment of openings 66 with openings 16. The upper portion of FIG. 3 shows the vent assembly of FIG. 2 with the slide member 54 in the open position. This corresponds to the position shown in FIG. 2. In contrast, the lower portion of FIG. 3 illustrates the vent assembly of FIG. 2 with the slide member 54 shifted to the closed position. FIG. 4A shows a portion of the vent assembly of FIG. 3 in the open position. FIG. 4B shows a portion of the vent assembly of FIG. 3 in the closed position.

FIG. 2 also illustrates one form of an actuator engaging portion 70 of the slide member 54. As can be seen in FIGS. 5 and 6, in connection with one specific form of actuator 40, the actuator engaging member 70 comprises a lower portion 72 spaced below the surface 58 and coupled by a downwardly projecting flange portion 74 to the main body of the slide member 54. Portion 72 of actuator engaging member 70, in the form shown, is provided with an opening or slot 76 for receiving a toe or tab portion 80 of the actuator embodiment shown in FIGS. 5, 6 and 7.

Although not required, for economic efficiency, slide member 54 may be formed out of a single sheet of material by simply cutting and bending the sheet in an appropriate manner. As a specific example, the slide member 54 may be formed of 18 to 20 gauge C.R. low carbon steel. The various embodiments are not limited to the form of slide member shown by member 54 or to the form of actuator engagement mechanism shown at 70. For example, a pin or handle may project upwardly from the air flow regulator where it can be grasped and moved to slide the air flow regulator relative to the wooden vent cover. The pin or handle typically would slide along a slot in the wooden vent cover. Other actuator mechanisms may also be used.

Various forms of couplers may be used to slidably mount the slide member 54 to the wooden vent cover 10. Screws and other fasteners may be used, for example. However, detachable couplers, particularly those which require no tools for installation, are particularly desirable. U.S. Pat. No. 6,227,962 illustrates one suitable form of coupler for a different form of air flow regulator.

As another more desirable example, in accordance with an illustrated embodiment, a first set of plural couplers, such as at least two spaced apart couplers is positioned adjacent to a first end portion of the wooden vent cover. The couplers of the first set are each inserted into a respective associated coupler guide opening (described below) and into engagement with the wooden vent cover so as to slidably couple the air flow regular to the wooden vent cover. Desirably at least one coupler of the first set is positioned adjacent to a first corner of the air flow regulator at the first end portion of the wooden vent cover. In addition, desirably at least one other coupler of the first set of couplers is positioned at the opposite corner of the air flow regulator and at the first end portion of the wooden vent cover. These couplers slidably couple the air flow regulator to the wooden vent cover. In addition, a second set of plural couplers, such as at least two spaced apart discrete couplers are positioned adjacent to a second end portion of the wooden vent cover and opposite to the first end portion of the wooden vent cover. Each of the couplers of the second set are inserted through an associated coupler guide opening and into engagement with the wooden vent cover. Desirably at least one coupler of the second set of couplers is positioned adjacent to a third corner of the air flow regulator at the second end portion of the wooden vent cover. In addition, desirably a second coupler of the second set of couplers is positioned adjacent to the opposite corner of the air flow regulator at the second end portion of the wooden vent cover. The second set of couplers also slidably couple the air flow regulator to the wooden vent cover. In a desirable form, each coupler comprises at least one first coupler portion coupled to and supporting the air flow regulator so as to permit sliding movement of the air flow regulator or slide member. In addition, each such coupler desirably comprises at least one second coupler portion which frictionally engages the wooden vent cover. As a specific example, second coupler portions which are compressed in at least one direction within coupler receiving openings of the wooden vent cover may be used. As a more specifically desirable example, the coupler receiving openings in the wooden vent cover may comprise one or more of the air flow openings. A particularly desirable form of coupler is a clip. As a specific example, the couplers may be made of a resilient band of material, such as of spring steel, bent into an appropriate shape.

In the embodiment shown in FIG. 2, a first set of two spaced apart couplers, each in the form of a clip 100, are positioned at a first end portion of slide member 54. In addition, a second set of couplers 102, each in the form of a clip, are positioned at the opposite end portion of slide member 54. The couplers 100, 102 in the form shown are discrete clips that are spaced apart from one another. In the embodiment shown in FIG. 2, each coupler is adjacent to a respective one of the corners of the slide member 54. Additional discrete couplers may be included in the first set and also in the second set, if desired.

The operation of the exemplary actuator 40 mentioned above will be best understood with reference to FIGS. 5, 6, 7 and 8. More specifically, with reference to FIG. 7, the actuator 40, in the form shown, comprises a lever 84 having a first portion 86 which is coupled to the air flow regulator. More specifically, in the embodiment shown, the tab 80 projects from the lever first portion 86 for insertion into the opening 76 of actuator receiving portion 72 of the slide member. In addition, the illustrated lever 84 includes a pivot portion 88 which, as can be seen in FIG. 5, in the illustrated embodiment, is positioned at least partially within the slot 16*a* of the wooden vent cover. More specifically, pivot portion 88 in the illustrated embodiment is configured for positioning entirely within the slot between walls of adjoining portions of the wooden vent cover that define slot 16*a*. In addition, lever 84 comprises a grasping portion 90 which projects from the pivot portion and generally away from the air flow regulator or slide member 54 when the vent assembly is assembled.

As can be seen in FIGS. 5, 6 and 7, the first or lower lever portion in the illustrated embodiment is not straight. In particular, the first lever portion 86 is bent, in this case, between the pivot portion and the tab 80. In addition, a shoulder 92 is provided between tab 80 and the lever portion 86. As can be seen in FIGS. 5 and 6, the shoulder 92 bears against the slot 76 as the actuator is operated.

FIG. 5 illustrates the slide member 54 in a fully open position. Lever 84 is pivoted in the direction indicated by arrow 94 to open the vent assembly. In contrast, FIG. 6 illustrates the vent assembly in the closed position. The lever 84 is pivoted in the direction indicated by arrow 96 to close the vent assembly. As can be seen in FIGS. 5 and 6, curved exterior surfaces of the pivot portion 88 engage the walls defining slot 16*a* to guide this pivoting motion. In addition, with the configuration shown, as the actuator is pivoted toward its open position in the direction of arrow 94, the distance $d_1$ between the pivot axis of pivot portion 88 and the undersurface 14 of wooden vent cover 10 increases. That is, the pivot axis is shifted closer to wooden vent cover surface 12. In one specific configuration, the distance $d_1$ is 0.267 inches. In contrast, as the lever 84 of this configuration is shifted toward its closed position in the direction of arrow 96 in FIG. 6, the distance between the pivot axis of pivot portion 88 and surface 14 is decreased. This is indicated by $d_2$ in FIG. 6. With the specific example shown, $d_2$ may be 0.22 inch. Thus, in effect, one form of lever 84 includes a floating pivot which moves toward the upper surface 12 of the wooden vent cover 10 as the actuator is shifted toward its open position. This assists in maintaining the upper portion of lever 84 at a location where it is easier to reach for use in adjusting the position of the slide member 54.

Although the dimensions of the lever form of actuator shown in FIGS. 5, 6, 7 and 8 may vary, specific exemplary dimensions for a construction in which the distance between surface 58 of slide member 54 and the upper surface of engaging member 72 is 0.244 inch are as follows. The lettering and angle designations set forth below correspond to the lettering and angles used in FIG. 8.

| Example 1 | Example 2 |
|---|---|
| $\theta$ = 25 degrees | $\theta$ = 25 degrees |
| $L_1$ = 0.110 inch | $L_1$ = 0.156 inch |
| $L_2$ = 0.401 inch | $L_2$ = 0.375 inch |
| $L_3$ = 0.250 inch | $L_3$ = 0.272 inch |
| $L_4$ = 0.358 inch | $L_4$ = 0.440 inch |
| $L_5$ = 0.104 inch | $L_5$ = 0.077 inch |
| $L_6$ = 0.138 inch | $L_6$ = 0.094 inch |
| T = 0.057 inch | T = 0.062 inch |

In addition, the width of the lever 84 may be 0.609 inch and width of the tab 80 may be 0.157 inch. The actuator lever 84 may be made of any suitable material and may, for example, be extruded of aluminum with the extrusion being separated into actuators of the appropriate width and with the tab 80 being formed by machining.

The clips 100,102 may take a number of forms. Desirable forms of clips 100,102 are illustrated in FIGS. 9, 10A, 10B, and 11. With reference to FIG. 9, the air flow openings 16,16*a* through wooden vent cover 10, as mentioned above, are defined by vanes 26 and respective portions of the end pieces 32,34. More specifically, the air flow openings are defined by respective spaced apart and adjacent walls 104, 106 of these components. The walls are angled relative to horizontal such as indicated in FIGS. 9 and 16 and as previously explained. The range of angles for surfaces 104,106 (e.g., about 12° to about 17° either side of vertical and more desirably 16° from either side of vertical) results in improved air flow throw and spread characteristics for a wooden vent cover. In addition, the walls 104,106 are spaced apart a distance $V_t$ in FIG. 9, corresponding to the width of the air flow slots 16. Although the dimensions of the air flow slots may vary, an exemplary $V_t$ is 0.24 inch.

Figures 19, 20:
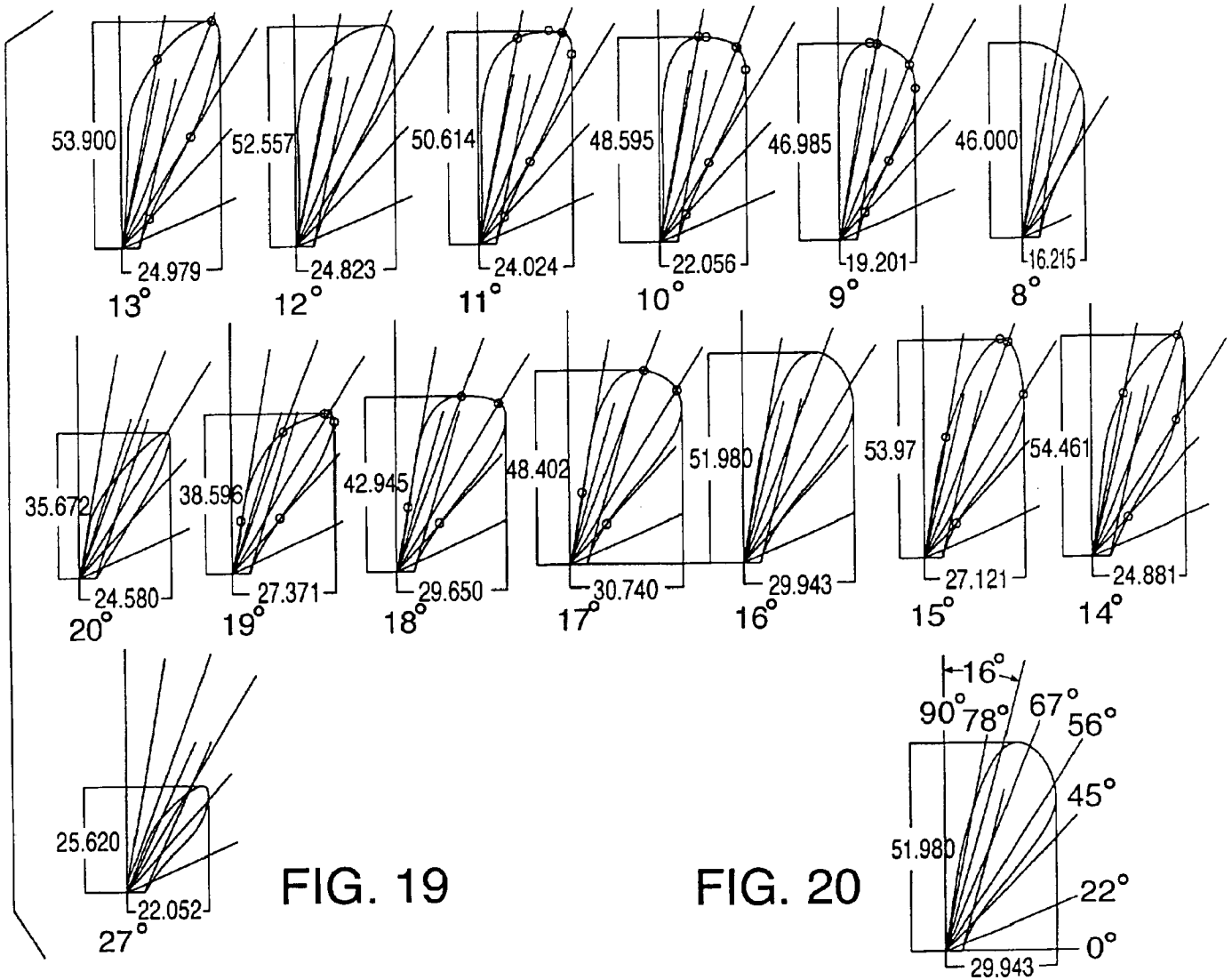
FIG. 19 schematically illustrates the spread and throw through vent openings having major vane surfaces at a variety of angles.
FIG. 20 schematically represents the spread and throw of a vent cover with vane major surfaces at an angle of sixteen degrees from vertical.

In this description, the term "throw" refers to the distance from the center of an outlet to a point in a mixed air stream where the highest sustained velocity of the mixed air stream has been reduced to a specified level. In addition, the term "spread" means the maximum distance measured parallel to the plane of the outlet, between the extremes of the terminal velocity envelope. In addition, the term "terminal velocity", at an outlet, means the highest sustained velocity in the mixed air stream where the highest sustained velocity of the mixed air stream has been reduced to a specified level. FIG. 19 illustrates actual tests and extrapolated results for a vent cover having vent openings with the surfaces 104,106 parallel to one another and configured as shown for the right hand vanes of FIG. 16. Actual air flow measurements were obtained for angles of the major surfaces 104,106 at eight degrees (8°), twelve degrees (12°), sixteen degrees (16°), twenty degrees (20°), and twenty-seven and one-half degrees (27½°). The results for angles that differ from these actual measured results were obtained by extrapolation. Thus, one-half of the total grill shown in FIG. 16 is represented in these measurements. In addition, the velocity at the front surface of the grill was 500 ft./min. The terminal velocity was 50 ft./min. The throw is thus maximum distance in the vertical direction (assuming the vent cover was oriented horizontally) at which the terminal velocity was measured. Thus, for the twelve degrees (12°) angled major surfaces 104,106 vent cover of FIG. 19, the throw was 52.557 inches. In addition, the spread was the maximum width for which the terminal velocity was measured in a plane parallel to the front surface of the vent cover from the center of the divider of the vent cover to the location of the terminal velocity. Thus, in the twelve degree (12°) major surface angled example, for one-half of the grill, the spread was 24.823 inches. The total spread would be expected to be doubled for an entire grill. FIG. 20 illustrates an example where the major surfaces 104,106 were at an angle of sixteen degrees (16°). This figure illustrates planes with respect to a coordinate system ranging from zero degrees (0°) (horizontal) to ninety degrees (90°) (vertical). Planes at twenty-two degrees (22°), forty-five degrees (45°), fifty-six degrees (56°), sixty-seven degrees (67°), and seventy-eight degree (78°) planes are illustrated.

Figure 21:
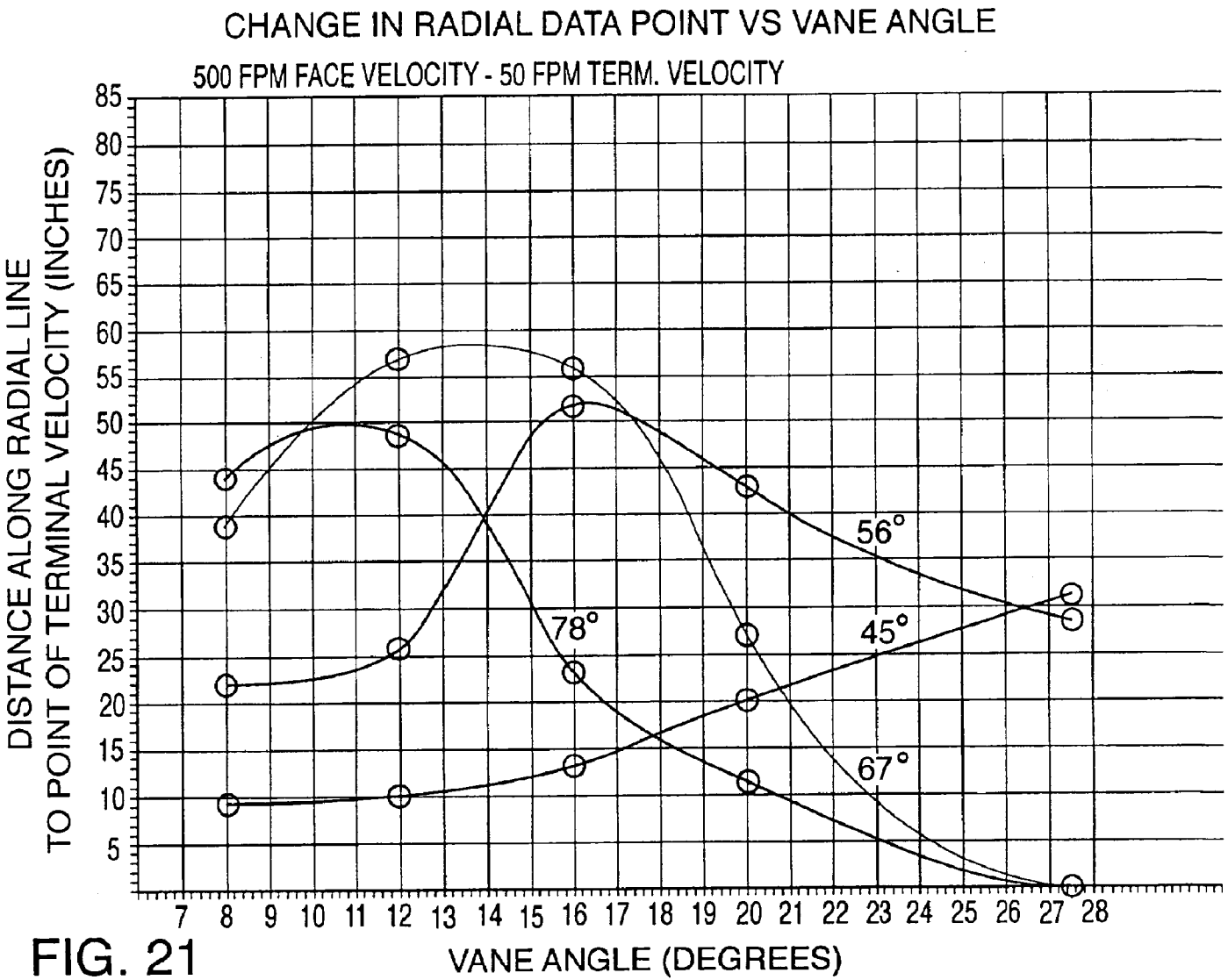
FIG. 21 schematically represents the data points at which the air flow has decreased to 50 feet per minute along radial lines at 22 degrees, 45 degrees and 78 degrees for various vane major surface angles from vertical.

Air flow data was collected to establish data points at which the terminal velocity had decreased from initial velocity of 500 ft./min. at the front surface of the vent cover to 50 ft./min. along radial lines at twenty-two degrees (22°), forty-five degrees (45°), fifty-six degrees (56°), sixty-seven degrees (67°), and seventy-eight degrees (78°) and for respective major surface vane angles at eight degrees (8°), twelve degrees (12°), sixteen degrees (16°), twenty degrees (20°), and twenty-seven and one-half degrees (27½°). These data points are shown in FIG. 21. For example, along the 56° radial line, at a vane major surface angle of 16°, the data point was about 52 inches where the terminal velocity had been reduced to 50 feet per minute. Through analysis, it was determined that the position of the data point along the fifty-six degree (56°) radial (the radial distance to the data point from the origin) appeared to have the greatest affect on the spread of the air flow pattern. In addition, the radial distance from the origin to the data point along the sixty-seven degree (67°) radial appeared to have the greatest affect on the throw. In extrapolating between the gathered data points, it was assumed that the air flow pattern transitioned smoothly from one form to another as the vane angle was changed. FIG. 21 thus represents a plot of the extrapolated and collected data point positions (the measured data points being circled in this figure) along a radial against the change in vane angle.

Looking at the sixteen degree (16°) vane angle, it is apparent from FIG. 21 that this vane angle provides an optimized combination of spread and throw. A vane angle near the highest point on the fifty-six degree (56°) radial, near a vane major surface angle of 16 degrees (16°), provides close to the maximum spread (one-half the total expected spread being represented by this data). The corresponding value for major surface angles of sixteen degrees (16°) on the sixty-seven degree (67°) curve, is within about two and one-half inches of the maximum throw. A vane angle of two degrees (2°) smaller yields the maximum throw (by about plus five percent) and a significant decrease in spread (approximately minus seventeen percent). A vane angle of two degrees (2°) larger yields a slight reduction in spread and a significant decrease in throw (by about seventeen percent (17%)).

Figure 22:
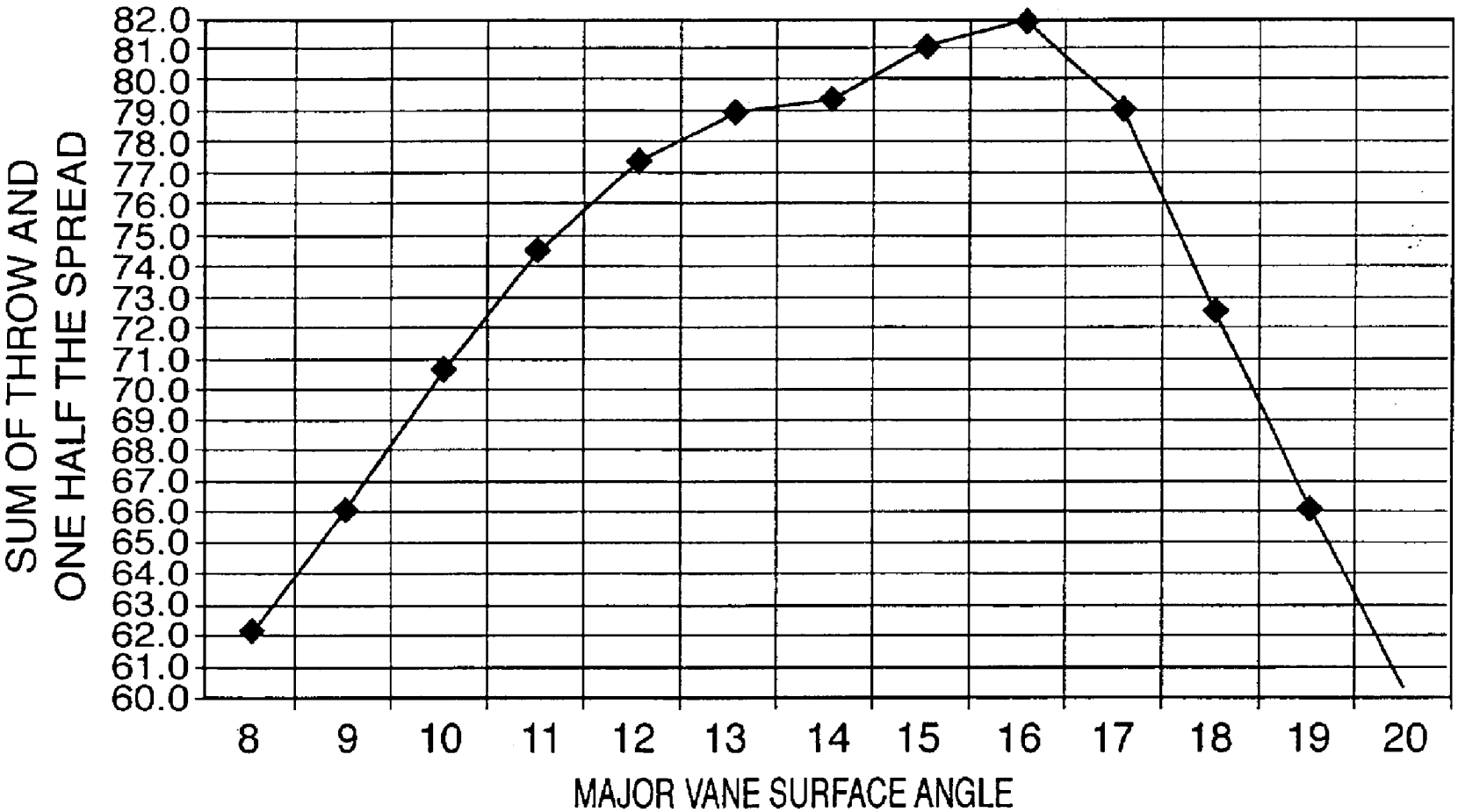
FIG. 22 is a graph of the sum of the spread and throw versus the major vane surface angle from vertical.

With reference to FIG. 22, the sum of one-half of the spread plus the throw for various vane angles is shown. For vane angles from slightly less than twelve degrees (e.g., 11.9–°) to slightly over seventeen degrees (e.g., 17.3°), the sum of spread and throw was greater than seventy-seven inches. One can also see that there is a significant degradation of performance at major surface vane angles below twelve degrees (12°) and above seventeen degrees (17°). Thus, an optimized vane angle is desirably from about twelve degrees (12°) to about seventeen degrees (17°) with a more desirable range being from twelve degrees to seventeen degrees (17°) and a most desirable angle being sixteen degrees (16°).

The clips 100 may be identical to one another or, although less desirable, they may be of a different configuration. In addition, the clips 102 may be identical to one another or, although less desirable, they may also be of a different configuration. In the example of FIG. 9, clips 100 are identical to one another and clips 102 are also identical to one another. Clip 100 will be described in detail in connection with FIGS. 10A and 11. Clip 102 is shown in FIG. 10B. The illustrated clip 100 comprises a first coupler portion which in this example comprises air flow regulator support portion 110. As can be seen in FIG. 9, support portions 110 support the slide member 54 from below. That is, portions 110 of the respective clips 100, 102 are typically positioned adjacent to surface 58 of the slide member 54. In this example, there is no need for the clips 100 or the clips 102 to be interconnected. Also, by making support portion 110 of a band of material having a width and flat upper supporting surface, enhanced stable support of slide plate 54 is provided. In addition, the illustrated clip 100 comprises a coupler portion 120 comprised of at least two coupler sections 114, 118. These coupler sections have a cross-sectional dimension in one direction (the direction corresponding to the distance $V_t$) which is greater than the distance $V_t$. Consequently, when the coupler portion 120 is inserted into a receiving air flow slot 16 or 16*a*, the coupler portion 120 is compressed in at least one dimension for wedging or frictional fit within the receiving opening. As a result, the slide member 54 is held in place without requiring tools to interconnect the slide member to the wooden vent cover in this example. The illustrated coupler portion 120 is comprised of an upwardly extending leg portion 114, a curved end portion 116, and a downwardly extending leg portion 118. By making portions 114, 118 to have an extended width, e.g. width w greater bearing of the coupler 120 against the walls of the air flow slot is achieved.

Referring back to FIG. 2, at the location where clip portion 110 extends upwardly or transitions to the portion 114, an associated guide opening is provided through the slide member 54. These guide openings may comprise respective slots having longitudinal axes extending in a direction which is parallel to the direction of travel of the slide member 54 relative to the wooden vent cover 10. These slots are desirably of a width which is slightly wider than the width of the illustrated clips. Exemplary slots are indicated at 124 in FIG. 2.

Desirably, the angle $\alpha$ (FIG. 10A) between support portion 110 and leg portion 114 is less than the angle C (FIG. 9). Consequently, as can be understood from FIG. 9, when the clip is installed (e.g., clip 100), an upwardly directed biasing force is exerted by the spring clip against the slide member 54. For example, in FIG. 10, the angle $\alpha$ may range from 60 to 80 degrees with 70 degrees being a specifically desirable example for the illustrated wooden vent cover. Thus, the angle $\alpha$ in FIG. 10A is desirably an acute angle. In FIG. 10B, the corresponding angle $\alpha'$ is an obtuse angle. The angle $\alpha'$ may range from 91 to 111 degrees with 101 degrees being a specifically desirable example for the illustrated wooden vent cover. The angle $\beta$ between leg portions 114, 118 is also, in the FIG. 10 form, desirably an acute angle and is selected such that adequate biasing forces are provided against the walls of a slot into which coupler section 120 is inserted. As a specific example, $\beta$ may range from 30 to 50 degrees, with 40 degrees being a specifically desirable example. The clip 100 in this form holds the slide member securely in place against the undersurface 14 of the wooden vent cover while still allowing the desired sliding movement. These clips 100,102 are of a simplified construction and in the desirable form shown, can be formed from a band of material by making only two bends in the material.

Although less desirable, the clips may be of wire or other materials which are formed in an appropriate shape. In this illustrated example of clip 100, the distal end of leg portion 118 hangs up on the wall of the vane and hold the slide member in place. Although less desirable, additional bends can be included in the clip.

Although variable, in one specific illustrative example, the dimensions of a specific clips 100, 102 are as follows:

$\alpha$=70 degrees for clip 100

$\alpha'$=101 degrees for clip 102

$\beta$=40 degrees

R=0.04 inch radius of curvature $l_1$=0.31 inch $l_2$=0.38 inch $l_3$=0.38 inch w=0.13 inch The length $l_1$, is desirably slightly greater than the distance $V_t$ between the walls of the air flow slot. The width w may vary and in a desirable form is at least five to ten times the thickness of the material used to form the clip. A resilient band of material, such as a rectangular strip of 0.016 inch thick S.S.TY.301 full hard stainless steel may be used for the clip.

FIGS. 12–16 illustrate an alternative embodiment of vent assembly with a wooden vent cover. In these figures, corresponding components, even if they differ somewhat in configuration, have been given the same numbers as in the previously described embodiments. The slots 124 may be of a different configuration from those shown in this construction. For example, the slots 124 at the end of the slide member 54 adjacent to actuator engaging portion 70 may be open at one end.

Figure 15:
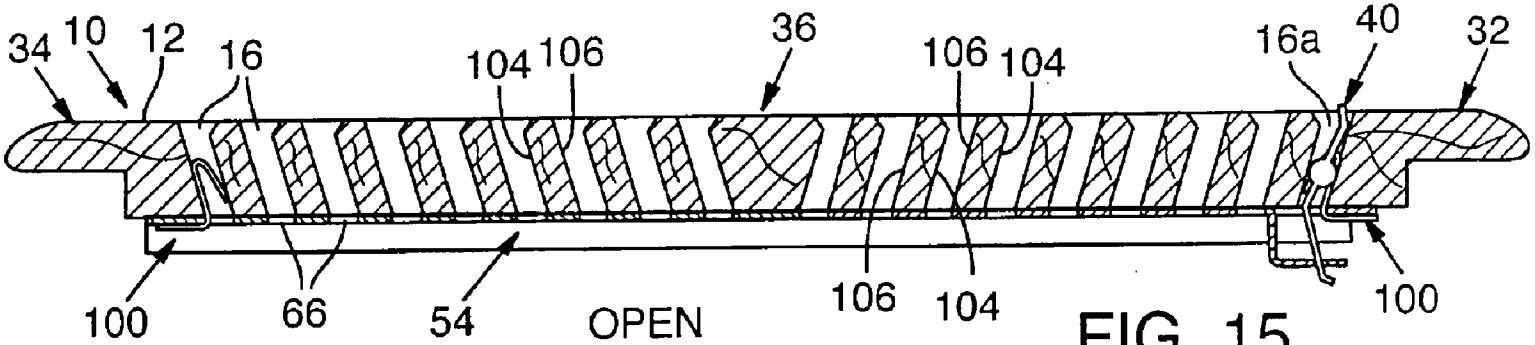
FIG. 15 is a longitudinal sectional view of the vent assembly of FIG. 12, taken along line 15—15 of FIG. 12 and with the vent assembly open.

FIG. 13 schematically illustrates the installation of a clip to couple the slide member 54 to the wooden vent cover. A dashed lined member 118 schematically shows the position of leg section 118 if it were not bent by the wall of slot 16 as it is inserted to the solid line position indicated in FIG. 13. FIG. 15 shows the slide member 54 in an open position while FIG. 16 shows the slide member in a closed position.

Figure 17:
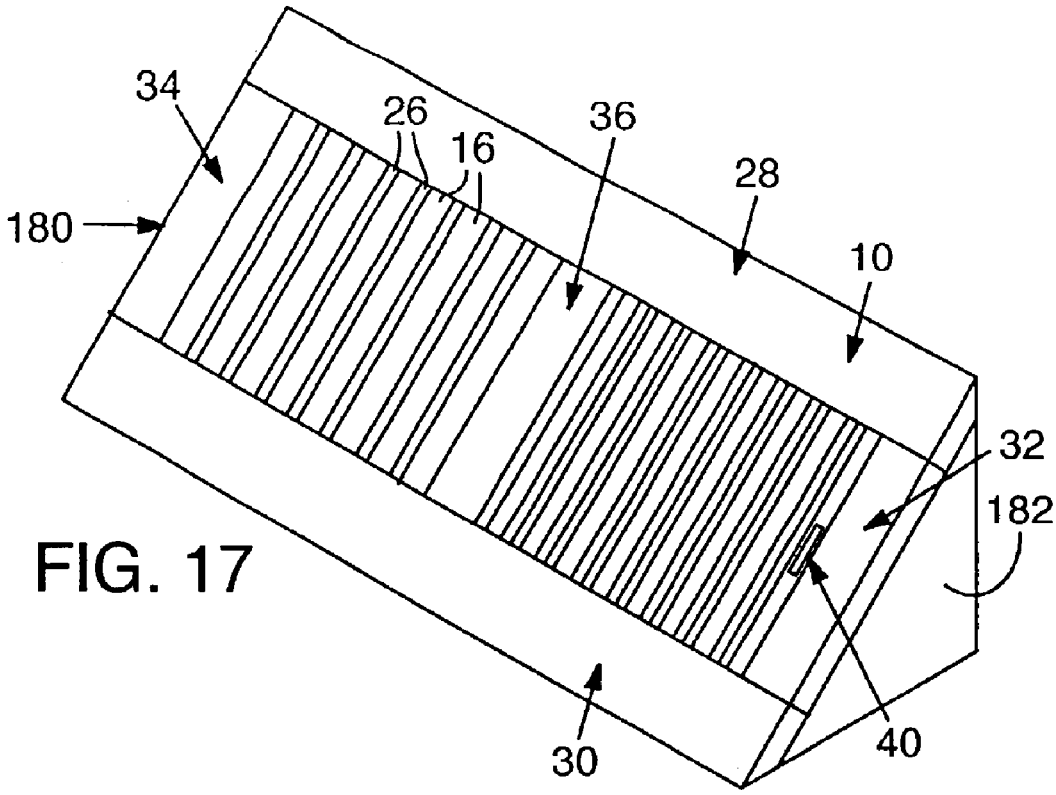
FIG. 17 illustrates a vent assembly usable at a corner location between a floor and wall of a building.
Figure 18:
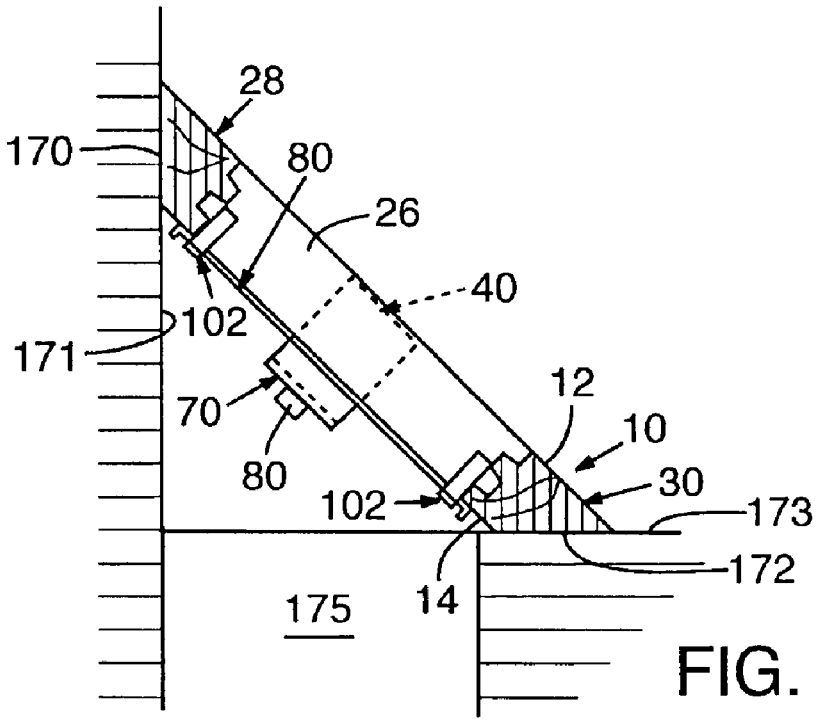
FIG. 18 is a sectional view of the vent assembly of FIG. 17, usable in a corner application.

FIGS. 17 and 18 illustrate one form of an embodiment of a wooden vent cover of a vent assembly which is suitable for a corner application. Given the low profile coupling and actuator configurations which may be used in accordance with embodiments described above, relatively little clearance is required to accommodate the vent assembly in such a corner application. By low profile, it is meant selecting components which project rearwardly from the wooden vent cover a reduced amount. In one specific example, the side portions 28,30 of the wooden vent cover 10 are beveled at 170,172 a desired amount for the particular application in question. For example, these edges may be beveled at 45 degree angles. As a result, edge 172 conforms to the configuration of a floor or other support 173 while edge 170 corresponds to the shape of a wall or other structure 171. A duct 175 is shown in communication with the space beneath the vent assembly of FIG. 18. The ends of the vent assembly in this embodiment may be closed by respective end members 180, 182 which may be triangular in shape. When installed, the lower edges of these end members may rest on the floor surface 173 while the upright edges of these end pieces may bear against the wall 171.

The wooden vent covers of the embodiments of FIGS. 12–19 have fixed wooden vanes with major surfaces 104, 106 at vane angles and ranges as previously described.

A building may have a plurality of vent assemblies of the various embodiments illustrated and described above.

Although described in connection with several illustrative embodiments, it should be noted that the present invention is not limited to the specific configurations disclosed to illustrate the invention. The present invention is directed toward novel and unobvious aspects and method acts alone and in various combinations and subcombinations with one another. I claim as my invention all such variations as fall within the scope and spirit of the following claims:

I claim:

1. A vent assembly for controlling the flow of air through an opening, comprising:

a wooden vent cover comprising a plurality of fixed position wooden vanes each having respective first and second major surfaces with at least a plurality of air flow openings defined in part by a first major surface of one vane and a second major surface of an adjacent vane, the first and second major surfaces being from about twelve degrees to about seventeen degrees of vertical when the wooden vent cover is in a horizontal orientation;

an air flow regulator slidable relative to the wooden vent cover from a first closed position in which the air flow regulator substantially blocks the flow of air through the air flow openings to second open positions in which air flow paths are provided through the air flow regulator and the air flow openings; and couplers operable to slidably couple the air flow regulator to the wooden vent cover, each of said couplers comprising a body having a first support portion positioned to support the air flow regulator and a second wooden vent cover engagement portion in frictional engagement with the wooden vent cover.

2. A vent assembly according to claim 1 wherein at least one of the couplers is of a band of material.

3. A vent assembly according to claim 1 wherein each of the first and second major surfaces is at the same angle from vertical when the wooden vent cover is in a horizontal orientation.

4. A vent assembly according to claim 3 wherein the angle is sixteen degrees either side of vertical when the wooden vent cover is a horizontal orientation.

5. A vent assembly according to claim 1 wherein the first and second major surfaces of each vane are parallel to one another.

6. A vent assembly according to claim 1 wherein, when the wooden vent cover is in a horizontal orientation, a first set of a plurality of adjacent vanes have first and second major vane surfaces at a first angle in one direction from vertical and a second set of a plurality of adjacent vanes have major vane surfaces at a second angle in a second direction opposite to the first direction from vertical.

7. A vent assembly according to claim 6 wherein the first and second angles are each of a magnitude of sixteen degrees.

8. A vent assembly according to claim 1 herein the second wooden vent cover engagement portion of each coupler is compressed while engaged with the wooden vent cover.

9. A vent assembly according to claim 8 wherein the wooden vent cover engagement portion is compressed by at least one of the first and second major vane surfaces.

10. A vent assembly according to claim 9 wherein each coupler comprises a band of material which is formed with only two angles.

11. A vent cover comprising:

a wooden vent cover comprising a wooden vent cover face and plural fixed vanes with vane surfaces angled to provide a sum total of one-half of the maximum total spread plus the maximum throw of at least 77 inches, wherein, with air flow exiting at the face of the wooden vent cover at five hundred feet per minute, the maximum throw is defined as being the maximum distance in a direction perpendicular to the wooden vent cover face where the flow rate has dropped to fifty feet per minute and the maximum total spread being the maximum distance in both directions parallel to the wooden vent cover face where the flow rate has dropped to fifty feet per minute; and an air flow regulator and plural couplers each coupled to the air flow regulator and to the vent cover and operable to slidably couple the air flow regulator to the vent cover.

12. A vent assembly for controlling the flow of air through an opening, the vent assembly comprising:

a wooden vent cover comprising a face and a plurality of air flow openings defined by fixed vanes having parallel major vane surfaces which are from about twelve to about seventeen degrees either side of a plane which is perpendicular to the face;

an air flow regulator of a rectangular shape with four corners, the air flow regulator being slidable relative to the wooden vent cover from a first closed position in which the air flow regulator substantially blocks the flow of air through the air flow openings to second open positions in which air flow paths are provided through the air flow regulator and the air flow openings;

at least four spaced apart discrete couplers, with a respective coupler being positioned adjacent to each of the corners of the air flow regulator, the couplers slidably coupling the air flow regulator to the wooden vent cover, each of said couplers comprising at least one first coupler portion coupled to the air flow regulator and at least one second coupler portion frictionally coupled to the wooden vent cover; and wherein the wooden vent cover comprises plural coupler receiving openings each for receiving a respective second coupler portion, each second coupler portion comprising a compressible member sized so as to be compressed in at least one direction when inserted into a respective one of the coupler receiving openings, and the compressible member engaging the wooden vent cover within the respective one of the coupler receiving openings to couple the air flow regulator to the wooden vent cover.

* * * * *